US005992573A

United States Patent [19]

Blain

[11] Patent Number: 5,992,573

[45] Date of Patent: Nov. 30, 1999

[54] ELEVATOR UP START

[76] Inventor: Roy W. Blain, Boellinger Hoefe 74078, Heilbronn, Germany

[21] Appl. No.: 08/936,180

[22] Filed: Sep. 24, 1997

[51] Int. Cl.[6] ..... B66B 9/04

[52] U.S. Cl. ..... 187/275

[58] Field of Search ..... 187/275

[56] References Cited

U.S. PATENT DOCUMENTS

| | | | |
|---|---|---|---|
| 4,194,534 | 3/1980 | Lawrence et al. . | |
| 4,637,495 | 1/1987 | Blain . | |
| 4,676,140 | 6/1987 | Haussler | 187/275 |
| 4,757,879 | 7/1988 | Rita | 187/275 |
| 5,014,823 | 5/1991 | Pelto-Huikko | 187/275 |
| 5,040,639 | 8/1991 | Watanabe et al. | 187/275 |
| 5,232,070 | 8/1993 | Blain | 187/275 |
| 5,289,901 | 3/1994 | Fargo | 187/275 |
| 5,522,479 | 6/1996 | Jo | 187/275 |

FOREIGN PATENT DOCUMENTS

| | | |
|---|---|---|
| 0433770A2 | 6/1991 | European Pat. Off. . |

*Primary Examiner*—William E. Terrell
*Assistant Examiner*—Khoi H. Tran
*Attorney, Agent, or Firm*—Eugene Chovanes

[57] ABSTRACT

A drive control system for an hydraulic elevator that reduces the time delay between the starting of an hydraulic pump in the system, and the first upward movement of the elevator.

3 Claims, 1 Drawing Sheet

ELEVATOR UP START

BACKGROUND OF THE INVENTION

1. Field of the Invention

This invention relates to a drive control system for an hydraulic elevator.

2. Description of Related Art

The present invention is an improvement over the invention of my prior U.S. Pat. No. 4,637,495 of January 1987 entitled Pressure/Viscosity Compensated Up Travel of an Hydraulic Elevator, incorporated herein by reference.

Hydraulic elevators should accelerate smoothly and approach their scheduled stopping positions gently and accurately and establish alignment of the bottom of an elevator car and a floor when the stopping point is approached from below at a creeping speed of travel during the final stage of approach. Different control systems have been developed for this purpose, which are however dependent in relatively large degrees on load and viscosity, and which suffer a delay in starting and an uncomfortable acceleration caused as result of said dependency.

SUMMARY OF THE INVENTION

An object of the present invention is to apply pressure and viscosity sensitive compensation devices within the control valve for up travel of an hydraulic elevator in such a way that the smoothness of elevator operation is maintained throughout higher loading and/or higher oil temperature conditions.

Another object of the invention is to shorten the delay time between an up command being given and the initial movement of the car.

Another object of the invention is to reduce the starting load on the motor.

Still another object of the invention is to apply pressure and viscosity sensitive compensation devices within the control valve for up travel of an hydraulic elevator in such a way that the devices can be easily and inexpensively built into existing control valves.

DESCRIPTION OF THE PREFERRED EMBODIMENT

Figure 1:
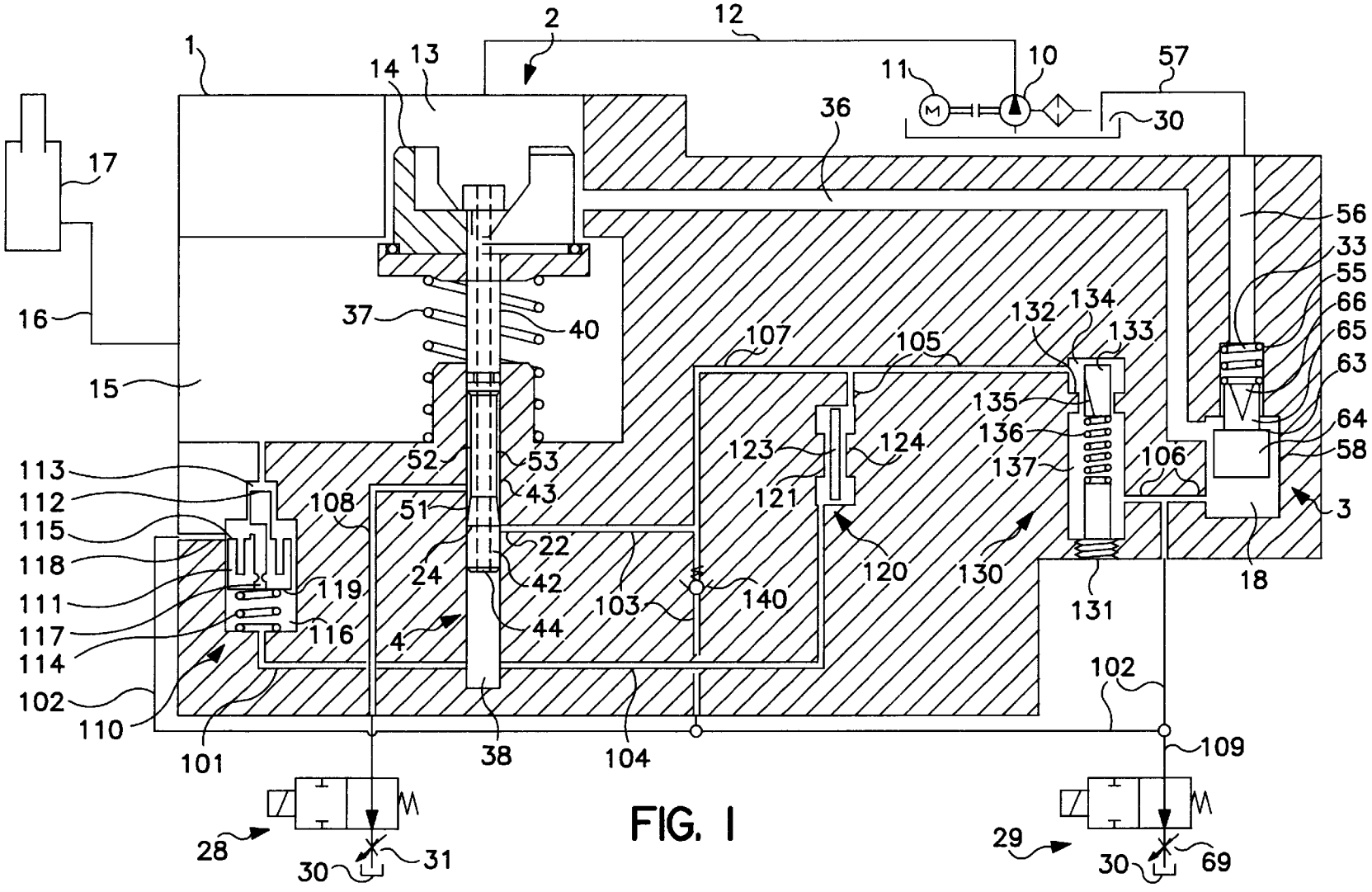
FIG. 1 is a schematic hydraulic circuit diagram illustrating an elevator control system including a by-pass valve in combination with a check valve and including pressure and temperature compensating devices.

Referring to FIG. 1, the illustrated embodiment comprises a valve body 1 containing bores in which are situated a check valve 2, a by-pass valve 3 and an up leveling speed valve 4. A pump 10, driven by motor 11, in communication with a pump chamber 13 via conduit 12 serves as a source of pressure fluid. Conduit 16 leads to an elevator cylinder 17 from a cylinder chamber 15 formed in the valve body 1.

The check valve 2 includes a flow guide 14 slidably guided in the control block pump chamber 13 which valve portion includes V-shaped restriction slots. The flow guide 14 is biased in a direction toward the pump chamber 13 by check valve spring 37 so that the check valve 2 automatically closes upon reduction of the pressure in the control block pump chamber 13, to prevent return of hydraulic oil from the elevator cylinder 17 to the chamber 13.

The leveling speed valve 4 is arranged co-axially relative to the check valve 2. To this end, the flow guide 14 has a cylindrical extension 40 which is slidingly guided in a corresponding bore contained in the valve body 1. The leveling speed valve 4 is connected in interlocking fashion to the check valve 2 by means of the extension 40 and includes a cylindrical part 42 which is a close running fit in a leveling speed bore 43 of the valve body 1. A control edge 24 is situated in the area of a leveling speed orifice 22. A conical control surface 51 sloping with small taper extends in a direction towards the flow guide 14 from the control edge 24. The surface 51 is formed with an angle of inclination of approximately 2 degrees and is divided by an edge 24 from the cylindrical part 42. The control surface 51 is continued at a top portion thereof by a cylindrical shank portion 52. Between the shank portion 52 and the leveling speed bore 43 an annular space 53 is formed. A passage 108 to discharge restrictor 31 leads out of the annular space 53. The solenoid valve 28 is a 2-position valve which is arranged to be switched to the illustrated conducting position in which throughflow occurs when the solenoid is de-energized, and to a blocking position to block the throughflow when it is energized. An outlet of the valve 28 is connected with an oil tank 30 via a discharge restrictor 31, which controls the quickness of the transition from full speed of the elevator to leveling speed, by limiting the rate of escape of oil through the leveling speed pilot system.

A bypass valve passage 36 branches off from the pump chamber 13, before the flow guide 14. An outlet bore 55 leads upwards from the passage 36. The bore 55 is followed by outlet passage 56 from which a bypass valve outlet conduit 57 leads to the oil tank 30. A bypass cylindrical section 64 is guided in an axially displaceable manner in the valve bore 58. A bypass valve chamber 18 is formed below the cylindrical section 64. The small difference in diameter between the bores 55 and 58 results in an annular surface 63 between a cylindrical section 64 and guiding extension 65 having V-shaped restrictor slots 66. The bypass valve 3 is biased in an opening direction by means of a valve spring 33. From the bypass valve chamber 18, a passage 106 and 102 lead on the one hand into a leveling speed passage 103 which leads into the leveling speed orifice 22, and on the other hand through a bypass valve chamber outlet passages 106, 102 and 109 to a solenoid stop valve 29. The solenoid valve 29 is, like solenoid 28, a 2-position valve which is set to a normal first position allowing throughflow when the solenoid 29 is de-energized, and a second position preventing throughflow when the valve 29 is energized. The output from the solenoid 29 is ducted to the oil tank 30 through an adjustable restrictor 69.

Operation of the Invention

The control system operates in the following manner. The pump 10 supplies hydraulic oil into the pump chamber 13 via the conduit 12 when an elevator car, arranged on the elevator cylinder 17, is to accelerate upward. The solenoid valves 28 and 29 are energized and close, blocking passages 108 and 109. This causes a pressure build up between pump chamber 13 and bypass valve chamber 18 via central bore 44, passage 101, short delay flow switch 110 and passage 102 on the left side of leveling speed valve 4; and passage 104, deceleration compensation restrictor 120, passage 105, acceleration compensating restrictor 130, and passage 106 on the right side of valve 4.

The short delay flow switch 110 is normally held open against spring 114 by main cylinder pressure acting in short delay spool cylinder chamber 113 upon the spool small diameter 112.

The flow switch allows a relatively high flow rate of pilot fluid to pass from the pump pressure chamber 13 through central bore 44, through connecting bore 101 into short delay pump chamber 116, through short delay orifice 117, shut off bore 118 and passages 102 and 106 into the bypass chamber 18, where it acts upon bypass valve 3 moving it quickly towards a partially closed position against spring 33, causing a rapid build up of pressure in the pump chamber 13. This build up of pump pressure also acts within the pressure chamber 116 upon the spool larger diameter 119 of short delay spool 111 so that as the pump pressure in chamber 13 is near to reaching the pressure in the cylinder chamber 15, the spool, influenced also by the force of spring 114 moves against the cylinder pressure such that the shut off bore 118 is sealed off by the lip 115 of the spool's large diameter 119. The rapid closing of the bypass valve is thereby interrupted just before the pump pressure exceeds that of the cylinder pressure, that is, just before the check valve 2 is forced to open and the car starts to move.

The foregoing ensures that when a command for up travel of the car is given, the delay of pump pressure built as the bypass valve closes is kept to a minimum so that the first movement of the car follows within a short time of the pump starting. The short delay flow switch can obviously be employed by other types of control valves in which a bypass valve may have a "dead stroke" effecting no movement of the elevator.

Parallel to the functioning of the flow switch 110, pilot fluid at pump pressure is also flowing from central bore 44, through connecting bore 104, deceleration compensating restrictor 120 and acceleration compensating restrictor 130.

Assuming the short delay function to be completed, the further closing of the bypass valve controlling the acceleration of the car, is controlled by adjustable acceleration compensating restrictor 130 as follows. Pilot oil flows through connecting passages 104, deceleration compensation restrictor 120, yet to be described, and into compensating pressure chamber 134 where it exerts a pressure upon pressure compensating pin 133 against spring 136, thereby partially closing the restrictor 135 cut into the pin 133, proportionally to the pump pressure. The rate of pilot fluid flowing through restrictor 130 therefore tends to remain the same independent of the system pressure which changes according to the load on the car. This controlled flow of pilot fluid passes through chamber 137, connecting passage 106 into bypass chamber 18, closing the bypass valve at a consistent rate to produce a smooth up acceleration of the car. Screw adjustment 131 enables the position of the spring 136 and pin 133 to be shifted relative to the bore lip 132, to obtain a faster or slower acceleration of the car as required.

To switch the elevator car traveling at full speed to creeping speed travel prior to reaching a stopping point, the solenoid of the valve 28 is de-energized so that the valve is switched to its illustrated throughflow position. The pilot fluid now flows out of the bypass valve chamber 18 to sump 30 via passages 106, 102, 103 and pilot check valve 140 to leveling speed orifice 22 over control surface 51, through annular space 53, connecting bore 108, solenoid valve 28 and discharge restrictor 31. The pressure in the bypass valve chamber 18 drops correspondingly, so that the force exerted by the pressure on the bypass valve 3 is no longer sufficient to overcome the opposing force of the spring 33 and pump pressure acting on the annular surface 63.

The bypass valve 3 commences to open allowing main oil flow from the pump chamber 13 to return to the oil sump 30 via valve passage 36 and outlet 56, thereby causing a slow down of the elevator dependent upon the rate at which pilot fluid escapes from the bypass valve chamber 18 through discharge restrictor 31. With other systems, at high pressures and/or temperatures, the bypass valve opens quicker during the deceleration phase of the elevator, than at lower pressures and/or temperatures causing undesirable changes in the ride comfort as well as in the length of time to up level.

In the case of the invention, at higher pressures and/or temperatures the rate of escape of oil from the bypass valve chamber through discharge restrictor 31 is prevented from increasing by partially flooding restrictor 31 with a separate pressure/temperature dependent source of pilot fluid controlled by compensating restrictor 120, resulting in a more consistent slow down of the car.

This pressure/temperature dependent source of pilot fluid flowing through restrictor 120, originates from the pump chamber 13 via central bore 44, leveling speed chamber 38 and pilot connecting bore 104 to the narrow deceleration compensating annulus 124 of the deceleration compensating restrictor 120, this annulus essentially being a long edged orifice formed by a compensating needle 123 or other suitable long edged restriction, within a compensating bore 121.

A long edged orifice has the characteristic of allowing a disproportionate increase in the volume of oil to pass through as temperature or pressure of the oil increases.

What is claimed is:

1. In a hydraulic control system having a source 10 of oil including pilot oil, under pressure created when a pump starts and runs from a signal to move an elevator;

a) a first connection, including a check valve, connecting the source 10 with a cylinder 17 of an elevator, the cylinder having a cylinder pressure;

b) a second connection, including a bypass valve, for bypassing said check valve, said bypass valve normally being biased by biasing spring to an open condition and having a bypass chamber 18;

the invention comprising c) a third connection, including an open-close flow switch 110, for passing pilot oil from the source 10 to said bypass chamber 18; the flow switch having a spool 111 with a bore, one end of said spool is adapted to be acted upon by an initially dominating cylinder pressure and the other end adapted to be acted upon by the pilot oil pressure; wherein, when pilot oil, flowing from said source 10 to said bypass chamber 18 via said bore 118, climbs to a pressure close to that of the cylinder pressure, the spool moves with the pilot oil pressure against the cylinder pressure to interrupt the flow of pilot oil passing through said bore 118, whereby a rapid build up of pressure in the bypass chamber 18 and a consequential rapid closing of the bypass valve is interrupted before the cylinder pressure is exceeded by the source pressure from said pump and therefore before the car starts to move, thus ensuring a reduced time delay between the start of the pump and first upward movement of the elevator.

2. A device of claim 1 having a spring at one end of the spool to bias the spool to either an open or closed position.

3. A device of claim 1 wherein the spool having a spool lip and the diameter of the spool is larger at the end adapted to receive the pilot oil pressure than at the end adapted to receive cylinder pressure and to ensure the moving of the spool 111 through the pilot oil pressure, thereby causing spool lip 115 to close the bore 118, while said source pressure from said pump is still lower than cylinder pressure, before the elevator starts to move.

* * * * *